US005147111A

United States Patent [19]

Montgomery

[11] Patent Number: 5,147,111

[45] Date of Patent: Sep. 15, 1992

[54] CAVITY INDUCED STIMULATION METHOD OF COAL DEGASIFICATION WELLS

[75] Inventor: Carl T. Montgomery, Plano, Tex.

[73] Assignee: Atlantic Richfield Company, Los Angeles, Calif.

[21] Appl. No.: 739,939

[22] Filed: Aug. 2, 1991

[51] Int. Cl.[5] ..... E21B 43/26; E21C 37/14

[52] U.S. Cl. ..... 299/16; 166/308

[58] Field of Search ..... 299/12, 16; 166/274, 166/307, 308, 305.1, 369, 370

[56] References Cited

U.S. PATENT DOCUMENTS

| | | | |
|---|---|---|---|
| 2,623,596 | 12/1952 | Whorton et al. | 166/274 |
| 3,384,416 | 5/1968 | Ruehl et al. | 299/16 |
| 4,043,395 | 8/1977 | Emery et al. | 166/263 |
| 4,250,965 | 2/1981 | Wiseman, Jr. | 166/305.1 |
| 4,305,464 | 12/1981 | Masszi | 166/370 |
| 4,391,327 | 9/1983 | DeCarlo | 166/307 |
| 4,400,034 | 8/1983 | Chew | 166/307 X |
| 4,471,840 | 9/1984 | Lasseter et al. | 166/280 |
| 4,665,990 | 5/1987 | Perlman | 166/307 |
| 4,679,630 | 7/1987 | Wyman | 166/305.1 |
| 4,913,237 | 4/1990 | Kutas | 166/308 |
| 4,995,463 | 2/1991 | Kramm et al. | 166/308 |
| 5,014,788 | 5/1991 | Puri et al. | 299/12 |

FOREIGN PATENT DOCUMENTS

| | | | |
|---|---|---|---|
| 1283388 | 1/1987 | U.S.S.R. | 299/16 |

OTHER PUBLICATIONS

"Cavity Stress Relief Method to Stimulate Demathanation Boreholes", A. K. Alain and G. M. Deness, SPE/-POE/GRI 12843, May, 1984.

"Light Oil Recovery from $CO_2$ Injection", SPE 18084, Oct., 1988.

"Analysis of Unconventional Behavior Observed During Coalbed Fracturing Treatments", P. D. Palmer et al., Apr., 1989.

*Primary Examiner*—David J. Bagnell

*Attorney, Agent, or Firm*—Drude Faulconer

[57] ABSTRACT

A cavity induced stimulation method for improving the initial production of fluids, e.g. methane, from a coal seam. A well is drilled and completed into the seam. A tubing string is run into the hole and liquid $CO_2$ is pumped down tubing while a backpressure is maintained on the well annulus. Pumping is stopped and the pressure is allowed to build until it reaches a desired elevated pressure (e.g. 1500 to 2000 psia). The pressure is then quickly released. The sudden release of pressure plus other factors cause the coal to fail and fragment into particles. The particles are removed to form a cavity in the seam. The above steps may be repeated until the desired cavitation is achieved.

7 Claims, 1 Drawing Sheet

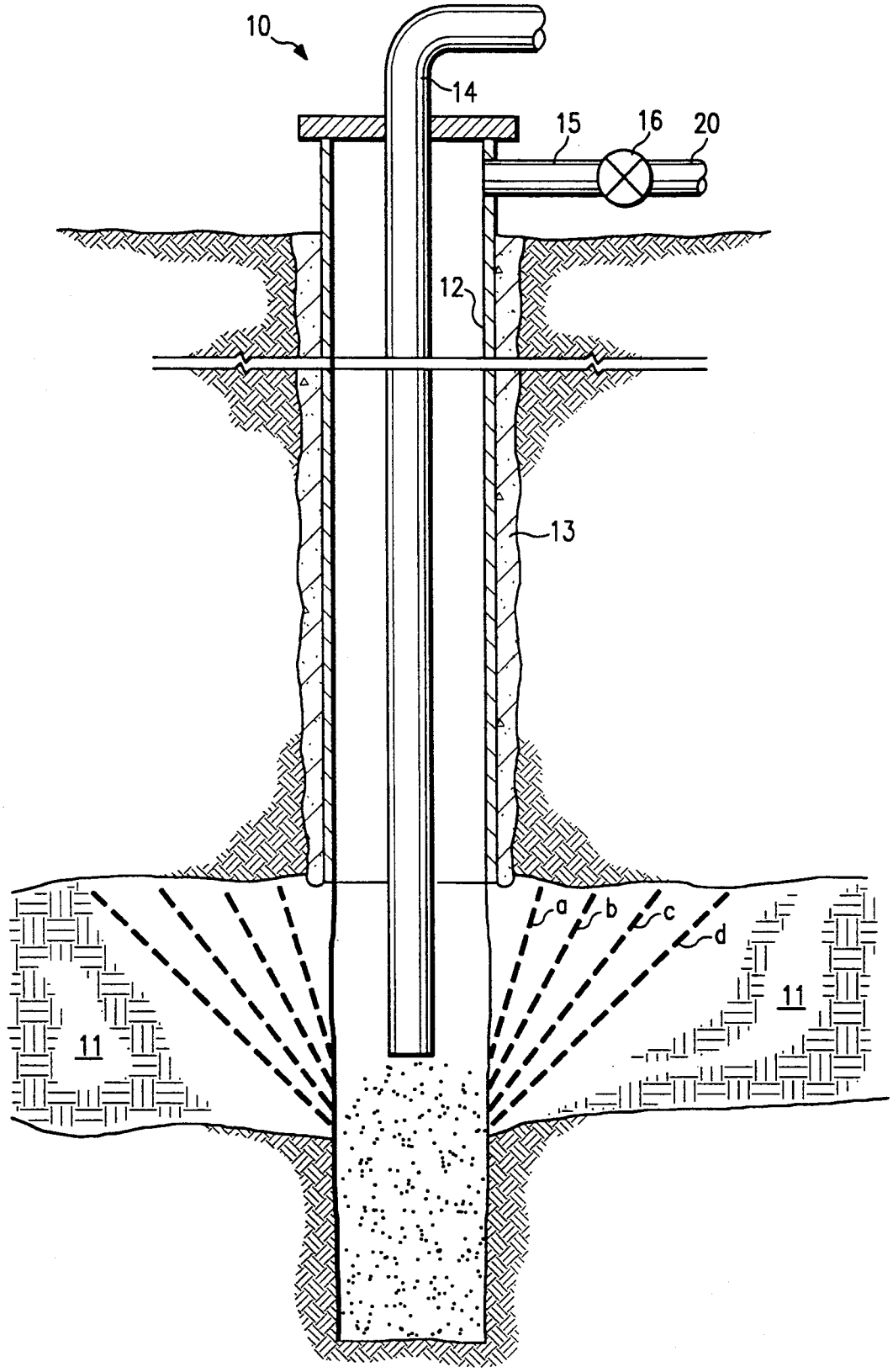
10
14
15
16
20
12
13
a
b
c
d
11
11

CAVITY INDUCED STIMULATION METHOD OF COAL DEGASIFICATION WELLS

DESCRIPTION

1. Technical Field

The present invention relates to the production of gas from a coal seam and in one of its aspects relates a method wherein liquid $CO_2$ is injected through a wellbore to form a cavity in a coal seam to stimulate the production of gases (e.g. methane) from the coal seam.

2. Background Art

Many subterranean coal seams have large volumes of hydrocarbon gases (e.g. methane) trapped therein. These gases represent a valuable resource if they can be produced economically, Also, where a coal seam is to be mined later, it is beneficial from a safety standpoint to produce as much of these gases as possible before the commencement of mining operations, i.e. degasification of the coal seam.

Presently, methane and any other gases are produced from the coal reservoirs through wells which are drilled into the coal seam. Once a well is drilled and completed, it is common to treat the coal seam in order to stimulate the production of methane therefrom. One such commonly used stimulation treatment involves hydraulically fracturing the coal seam much in the same way as are other more conventional oil and gas bearing formations fractured; e g. see U.S. Pat. No. 4,995,463.

Another technique which has been proposed for stimulating coal seam is one which is sometimes generally referred as "cavity induced stimulation". In this technique, a wellbore is drilled through a coal seam and a cavity is formed within the seam adjacent the wellbore. As the cavity is formed, the vertical stress component which normally acts on the coal above the cavity is partially transferred to the sides of the cavity which, in turn, causes the coal to become loaded inwardly as the cavity is being formed. Since this increased load will normally be greater than the natural load bearing capability of the coal, the coal will fail and break up into small fragments. As the coal fragments are removed through the wellbore, a large cavity is formed thereby providing a relaxed zone in which existing fractures can open making the coal and surrounding rock more permeable to gas flow. This technique can be continued until the bearing capacity of the coal equals or exceeds the redistributed stress. The net effect of forming a cavity into which the surrounding coal can collapse is the production of a highly permeable zone filled with fine grained coal particles. For a more complete description of the mechanics involved in a typical cavity induced stimulation; see "Cavity Stress Relief Method To Stimulate Demethanation Boreholes", A. K. Alain and G. M. Denes, SPE/DOE/GRI 12843, presented at the 1984 SPE/DOE/GRI Unconventional Gas Recovery Symposium, Pittsburg, Pa., May 13–15, 1984.

The cavity used in the above described technique can be formed in different ways. For example, in the above cited paper, the cavity in the coal seam is disclosed as being formed by jetting water from the lower end of a dual drill pipe string while using compressed air to remove the resulting coal fragments.

Another known technique which has been used to form a cavity in a cavity induced stimulation method involves drilling and completing a wellbore into a coal seam. A tubing string is then lowered into the wellbore and the well annulus is closed. Compressed air is supplied through the tubing string to build up a high pressure on the coal seam adjacent the wellbore. The wellbore is then opened to suddenly vent the pressure thereby allowing the air within the cleats or fractures of the coal seam to expand and produce a backpressure which overcomes the induced hoop stress within the coal. When this happens, the coal fails and breaks into fragments which are then removed through the tubing string. This process is preferably repeated until the desired permeable zone (i.e. cavity having coal fragments therein) within the seam is formed.

While this technique has increased the initial methane production in some wells by as much as 4 to 5 fold when compared to wells which were hydraulically fractured, it has also been shown that this cavity induced stimulation technique has not worked in other wells. Studies indicated that this failure may be due to the cleat density being much less than it was in the successful completed wells. More likely, the failures were due to the large hoop stresses induced in the coal during the drilling process. The lower cleat density increases the strength of the coal sufficiently that these hoop stresses cannot be overcome with the normal cavitation completion techniques.

SUMMARY OF THE INVENTION

The present invention provides a cavity induced stimulation method for improving the initial production of fluids, e.g. methane, from a subterranean coal formation or seam. In carrying out the method, a well is a preferably drilled to a point substantially at the top of the coal seam and is cased to that depth. The wellbore is then extended below the cased wellbore and into the seam. A tubing string is run into the hole through which air is flowed to thereby displace all liquids in the wellbore with air.

Next, liquid carbon dioxide ($CO_2$) is pumped down tubing while a backpressure (i.e. approximately the critical temperature of liquid $CO_2$) is maintained on the well annulus. This continues until the tubing has been cooled by the $CO_2$ to a temperature below the critical temperature of the $CO_2$, at which time, the annulus is completely shut in. The pumping of the liquid $CO_2$ is continued until the $CO_2$ has penetrated a desired depth (5 to 8 feet). Next, a gas (e.g. compressed air, nitrogen, etc.) is flowed down tubing to displace the liquid $CO_2$ in the tubing into the coal seam.

All pumping is stopped and the pressure is allowed to build until it reaches a desired elevated pressure (e.g. 1500 to 2000 psia). The pressure is then quickly released. The sudden release of pressure plus other factors cause the coal to fail and fragment into particles or the like. At least a part of these particles (preferably all) are then removed from the wellbore by circulating a fluid, e.g. water, through the wellbore. The above steps may be repeated until the desired cavitation is achieved.

Several advantages are achieved by using liquid $CO_2$ in the present cavity induced stimulation method, e.g. (1) when the pressure on the coal seam is quickly released, the liquid $CO_2$ will vaporize causing a backpressure which causes the coal to fail; (2) as the liquid $CO_2$ vaporizes, it drops the temperature in the coal seam below 32° F. causing the connate water in the coal to freeze thereby weakening the coal; (3) the liquid $CO_2$ will dissolve the natural tars, amberlite and asphalt which are inherently present in cleat structure of the coal seam; and (4) as the liquid $CO_2$ vaporizes, carbonic acid is formed which will dissolve any natural carbonates in the coal seam, still further weakening the coal and increasing the near wellbore permeability.

BRIEF DESCRIPTION OF THE DRAWINGS

The actual construction, operation, and apparent advantages of the present invention will be better understood by referring to the drawings in which like numerals refer to like parts and in which:

The figure is a elevational view, partly in section, of a subterranean coal seam or formation completed with the cavity induced stimulation method of the present invention.

BEST KNOWN MODE FOR CARRYING OUT THE INVENTION

In accordance with the present invention, a cavity induced stimulation method is used to complete a subterranean coal formation or seam to thereby improve the initial production of fluids, e.g. methane, therefrom. Referring more specifically to drawings, the figure illustrates a well 10 which has been drilled into a subterranean coal formation or seam 11. While the well is shown as being vertical, it should be understood that the present invention can be used equally as well in a horizontal or inclined well. Preferably, the well is first drilled to a point substantially at the top of seam 11 and is cased 12 and cemented 13 to that depth, as will be understood by those skilled in the art. Drilling is then resumed to extend the wellbore below the cased wellbore and into seam 11. The wellbore is completed openhole below casing 12. A tubing string 14 is run into the hole and any debris in the hole is removed through tubing 14. Air is then flowed down the tubing with returns being taken through casing outlet 15 or vice versa to thereby displace substantially all of the liquids and solids in the wellbore with air.

Next, liquid carbon dioxide ($CO_2$) is pumped down tubing 14 while valve means 16 on casing outlet 15 is adjusted to hold a high backpressure (e.g. 1000 psi, approximately the critical pressure of liquid $CO_2$) in well annulus 18. The critical temperature and pressure of $CO_2$ are 87.8° F. and 1071 psia, respectively. This is continued until the tubing has been cooled by the $CO_2$ to a temperature below the critical temperature of the $CO_2$ at which time annulus 18 is completely shut in.

The pumping of the liquid $CO_2$ is continued at matrix rates (i.e. rates below the mininum in-situ stress) until the $CO_2$ has penetrated a desired depth (5 to 8 feet) into the coal seam 11. For example, this would take approximately 12 to 15 barrels of liquid $CO_2$ for a 25 foot thick coal seam having approximately 5% porosity. Next, a gas (e.g. compressed air, nitrogen, etc.) is flowed down tubing 14 to displace the liquid $CO_2$ from the wellbore into the coal seam 11.

When the $CO_2$ has been displaced into the coal seam, all pumping is stopped and the pressure in the wellbore is allowed to build until it reaches a pressure (e.g. 1500 to 2000 psia) equal to the safety rating of valve means 16 (e.g. pop-off valves). At this time, valve means 16 opens, either automatically or manually, and the pressure is quickly released through "blooey" line 20 to a safe source (not shown). Valve means 16 remain open until the pressure in the wellbore drops to the reservoir pressure of seam 11. However, if the casinghead pressure is lower than the reservoir pressure (e.g. may be caused by the liquid $CO_2$ freezing the water in the coal seams), the valve may be closed to allow the $CO_2$ to vaporize to again build up the pressure in the wellbore before the valve is reopened to quickly release the new elevated pressure.

The sudden release of pressure plus other factors, which will be more fully discussed below, causes the coal to fail and fragment into particles or the like. These particles are then removed from the wellbore by circulating a fluid, e.g. water, down tubing 14 to force the coal particles, as a slurry, up the annulus 18 and out casing outlet 16. Of course, reverse circulation can equally be used as will be understood by those skilled in the art. The above steps are repeated (e.g two to four times, idealized by the dotted lines a,b,c,d on the figure) until the desired cavitation is achieved. The actual desired size of the cavity will depend on the thickness and strength of a particular coal seam, etc., keeping in mind that if cavity becomes to big, there is a risk that the seam may collapse and severely damage the casing and tubing in the wellbore.

By using liquid $CO_2$ in the present cavity induced stimulation method, several advantages are achieved over prior methods using a gas as the sole means for pressuring the wellbore. First, when the pressure on the coal seam is quickly released, the liquid $CO_2$ will vaporize causing a backpressure to be built up in the coal cleats which overcomes the induced hoop stresses whereby the coal will fail. Second, as the liquid $CO_2$ vaporizes, it will absorb heat from the coal seam due to the heat of vaporization which is 2.4 kilocalories per mole at 0° C. When the temperature in the coal seam drops below 32° F., the connate water in the coal seam will freeze causing a 4 to 5% increase in the water/ice volume. This volumetric increases will weaken the coal and induce microfractures throughout the affected coal structure.

Additionally, the liquid $CO_2$ will dissolve the natural tars, amberlite and asphalt which are inherently present in cleat structure of the coal seam thereby further weakening the coal and increasing the near wellbore permeability. Further, as the liquid $CO_2$ vaporizes, the gaseous $CO_2$ will dissolve in water to form carbonic acid which, in turn, will dissolve any natural carbonates in the coal seam, still further weakening the coal and increasing the near wellbore permeability.

What is claimed is:

1. A cavity induced stimulation method for improving the production of fluids from a subterranean coal seam, said method comprising:

drilling a wellbore to a point substantially at the top of the coal seam;

casing said wellbore;

drilling below the cased wellbore to extend the wellbore into said coal seam;

lowering a tubing into the wellbore to a point adjacent the wellbore; said tubing forming an annulus with the wall of the wellbore;

flowing liquid $CO_2$ down said tubing while maintaining a backpressure on said annulus at about the critical temperature of liquid $CO_2$ until the tubing has been cooled by the liquid $CO_2$ to the critical temperature of liquid $CO_2$ and is then increased to from about 1500 psia to 2000 psia;

displacing said liquid $CO_2$ into said coal seam;

shutting in the wellbore and allowing the pressure to build on the coal seam; and releasing said pressure quickly to thereby cause at least a portion of the coal seam to fail and fragment into coal particles in said wellbore.

2. The method of claim 1 including:

removing at least part of the coal particles from the wellbore to form a cavity in said coal seam.

3. The method of claim 2 wherein the liquid $CO_2$ is displaced by compressed air.

4. The method of claim 3 including:

repeating said steps of said method to thereby enlarge said cavity.

5. The method of claim 4 wherein said steps are repeated from 2 to 4 times.

6. The method of claim 1 wherein said coal particles are removed from the wellbore by circulating a fluid through said tubing and annulus.

7. The method of claim 1 including:

shutting the wellbore after said pressure has been released to allow the pressure to rebuild on said coal seam; and releasing said rebuilt pressure quickly to cause at least an additional portion of said coal seam to fail.

* * * * *